US005949462A

United States Patent [19]

Esplin et al.

[11] Patent Number: 5,949,462

[45] Date of Patent: Sep. 7, 1999

[54] INK JET PRINTER

[75] Inventors: Ernest I. Esplin, Sheridan, Oreg.; Jeffrey J. Anderson, Camas, Wash.; Jeffery J. Clark, Tigard, Oreg.; Terry A. Smith; Mike C. Gordon, both of Wilsonville, Oreg.; Raul Krivoy, Beaverton, Oreg.

[73] Assignee: Tektronix, Inc., Wilsonville, Oreg.

[21] Appl. No.: 08/865,904

[22] Filed: May 30, 1997

Related U.S. Application Data

[63] Continuation of application No. 08/379,231, Jan. 27, 1995, Pat. No. 5,710,586.

[51] Int. Cl.[6] ..... B41J 29/13

[52] U.S. Cl. ..... 347/108

[58] Field of Search ..... 347/108, 103, 347/88, 22; 355/30; 399/92

[56] References Cited

U.S. PATENT DOCUMENTS

| | | | |
|---|---|---|---|
| 4,015,272 | 3/1977 | Yamamori et al. | 346/140 |
| 4,543,591 | 9/1985 | Terasawa | 346/140 |
| 4,600,931 | 7/1986 | Terasawa | 346/140 |
| 4,800,403 | 1/1989 | Accattino et al. | 346/140 |
| 4,814,794 | 3/1989 | Sato | 346/140 |
| 4,893,137 | 1/1990 | Ebinuma et al. | 346/134 |
| 4,901,095 | 2/1990 | Perra, Jr. et al. | 346/140 |
| 4,959,673 | 9/1990 | Noda | 346/140 |
| 4,970,535 | 11/1990 | Oswald et al. | 346/140 |
| 5,184,147 | 2/1993 | MacLane et al. | 346/1.1 |
| 5,238,317 | 8/1993 | Bohmer et al. | 400/693 |
| 5,245,357 | 9/1993 | Maruyama et al. | 347/134 |
| 5,372,852 | 12/1994 | Titterington et al. | 427/288 |
| 5,502,476 | 3/1996 | Neal et al. | 347/103 |

*Primary Examiner*—N. Le
*Assistant Examiner*—Judy Nguyen
*Attorney, Agent, or Firm*—Charles F. Moore; Bennet K. Langlotz

[57] ABSTRACT

A computer printer having a frame contained within a housing, a media transport and printing mechanism attached to the frame within the housing is provided with at least one debris shield positioned above the printing mechanism to protect it from falling debris. The at least one debris shield may be positioned below an air flow path generated by printer ventilation, and the printer may employ a transfer surface on which an image is generated prior to transfer to a media sheet, and above which the debris shield is positioned.

17 Claims, 3 Drawing Sheets

INK JET PRINTER

This application is a continuation of application Ser. No. 08/379,231 filed Jan. 27, 1995, now U.S. Pat. No. 5,710,586.

FIELD OF THE INVENTION

This invention relates to computer printers, and more particularly to ink jet printers having ink jet orifice plates susceptible to obstruction by debris.

BACKGROUND AND SUMMARY OF THE INVENTION

Ink jet printers create a printed image on a surface by ejecting ink through orifices in a print head face plate onto the surface. To provide fine image resolution, the ejected ink droplets are very small, as are the orifices. Thus, an orifice may be partially or completely blocked by a small particle, thereby impairing printing. Paper fibers are commonly released into the printer environment during printing, and are the cause of some orifice obstructions. Paper fibers and other debris on a surface to be printed may be transferred to the print head face plate during printing, because the print head is positioned close to the surface to minimize droplet mispositioning due to off axis shooting that would cause an imprecise image.

Some ink jet printers employ a wax-like phase change ink that is melted for ejection onto a liquid intermediate transfer layer on a support surface of a rotatable transfer drum to form the image. When a complete image is formed, it is then transferred to a media sheet. Such printers preferably use a silicone liquid film as liquid intermediate transfer layer on the drum to facilitate release of the image to the sheet. However, the liquid film may collect debris and transfer it to the print head face plate. In addition, such printers require ventilation to remove heat generated by the ink melting apparatus and other heated elements. This keeps the support surface of the rotatable transfer drum at a selected temperature moderately above ambient, and cools internal electronic components. The resulting internal airflow may entrain contaminant particles and deposit them onto the face plate, onto media sheets, or onto transfer surfaces that subsequently carry them to the face plate.

While infrequent, an obstructed orifice nonetheless causes unacceptable printing, but may usually be cured by purging all orifices. This is generally effective, but consumes ink resources, takes time, and gives a reduced perception of quality by the user. In much rarer instances where the obstructed orifices are not cured by a purge, professional service may be required. Printers having permanent print heads benefit most from the avoidance of obstructions that might be more readily cured in printers with disposable inexpensive print heads that are customer replaceable.

The apparatus disclosed herein avoids or reduces the above limitations by providing a computer printer having a frame contained within a housing, a media transport and printing mechanism attached to the frame within the housing, and at least one debris shield above the printing mechanism to protect it from falling debris. The at least one debris shield may be positioned below an air flow path generated by printer ventilation, and the printer may employ a transfer surface on which an image is generated prior to transfer to a media sheet, and above which the debris shield is positioned. Where a plurality of debris shields are employed, at least one is transparent to facilitate locating and removing media sheet jams.

DETAILED DESCRIPTION OF A PREFERRED EMBODIMENT

Figure 1:
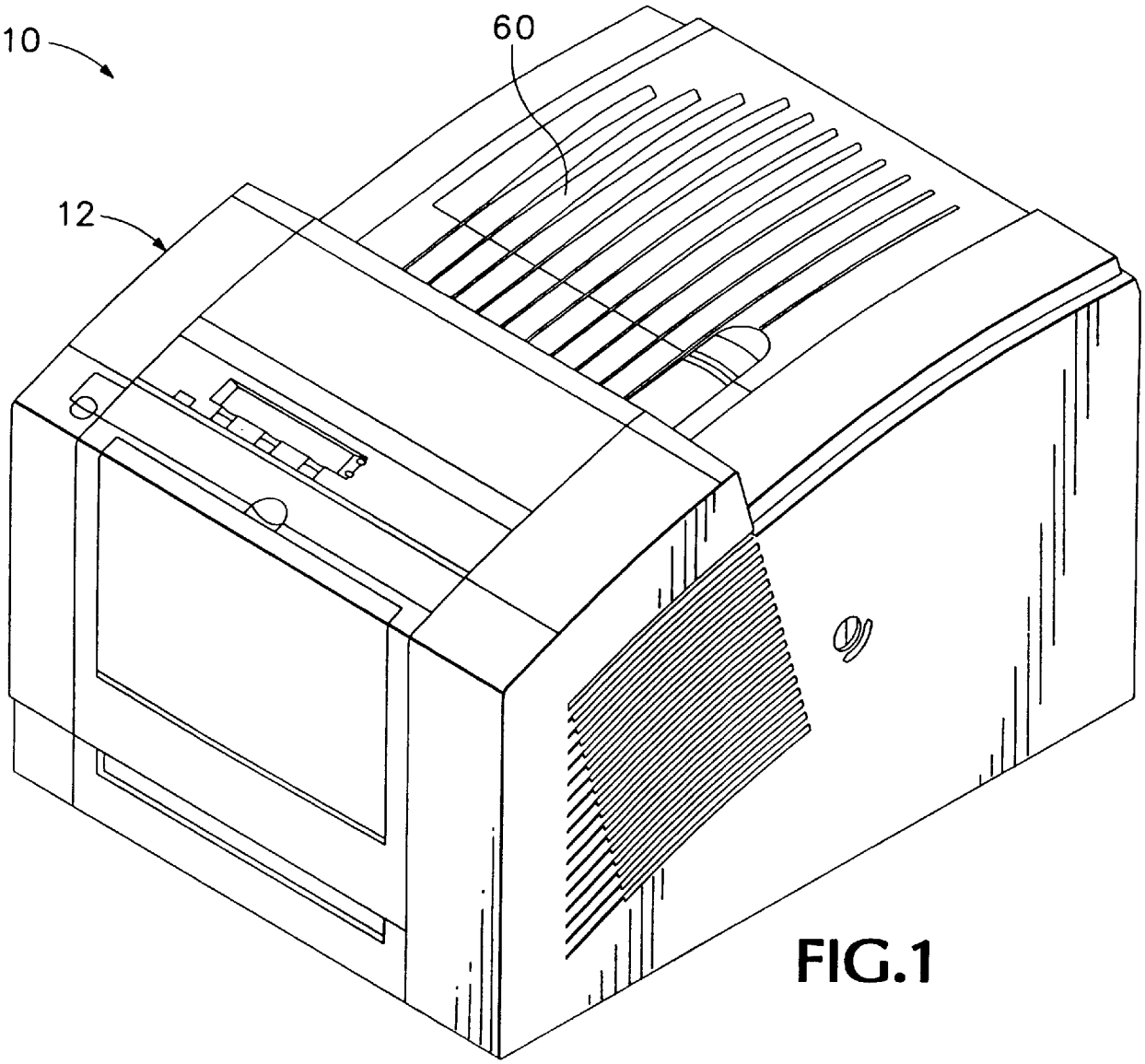
FIG. 1 is an exterior isometric view of a printer according to a preferred embodiment of the invention.
Figure 2:
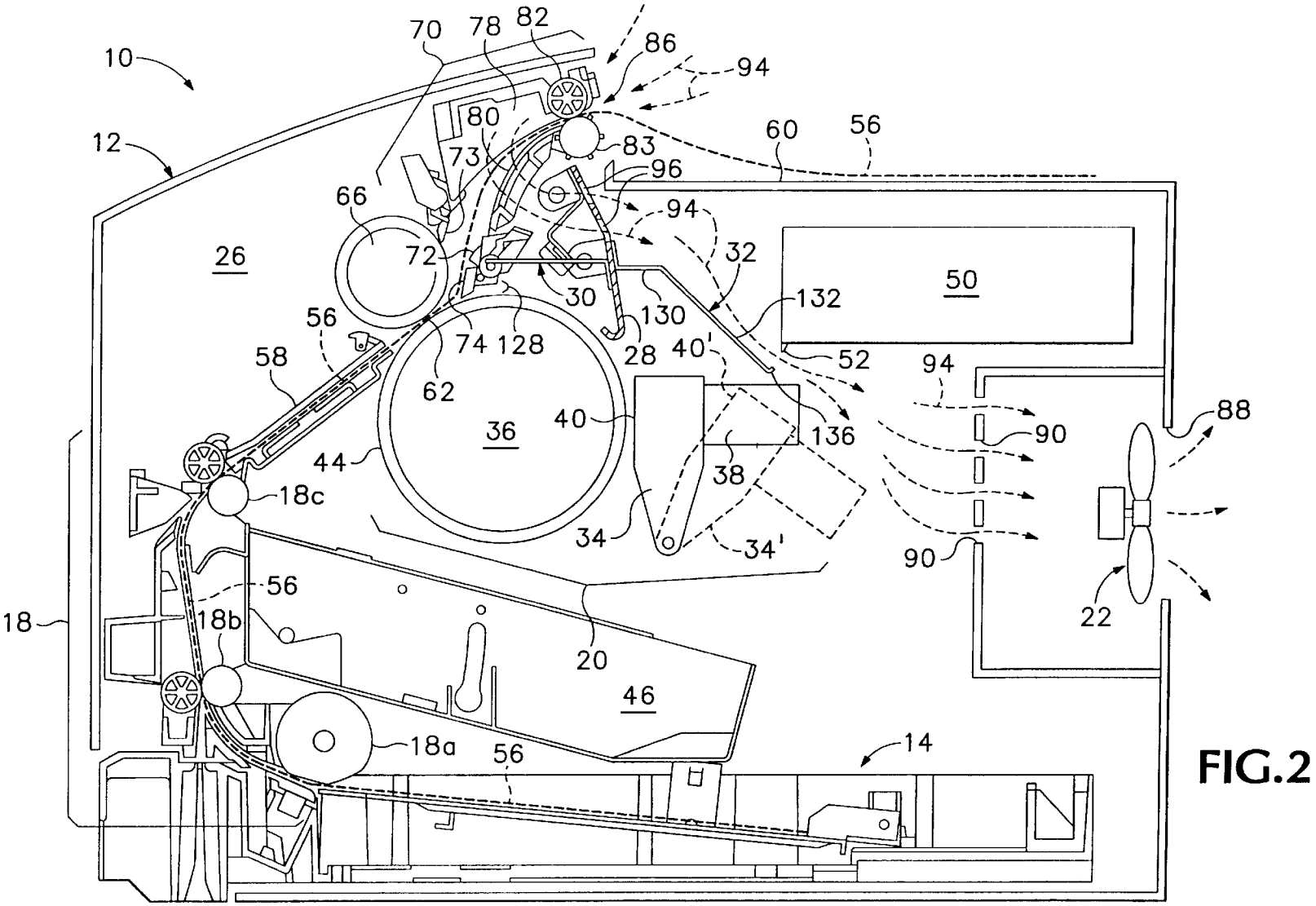
FIG. 2 is a sectional side view of the printer of FIG. 1.

FIG. 1 illustrates a phase change ink jet image transfer printer indicated generally by the numeral 10 having a housing also indicated generally by the numeral 12. As shown in FIG. 2, the housing 12 contains a media supply tray 14, a media transport mechanism 18, a printing mechanism 20, and a power supply having a fan ventilator 22, all indicated generally by their respective numerals. A frame 26 (portions not shown) provides a rigid structure to which the major printer components are connected. A perforated frame member 28 is positioned above the printing mechanism, and supports first and second debris shields indicated generally by the numerals 30 and 32, which are also positioned vertically above the printing mechanism components.

A phase change ink transfer printer and appropriate phase change ink are described in U.S. Pat. No. 5,372,852 issued Dec. 13, 1994, which is specifically incorporated by reference hereinafter in pertinent part.

The printing mechanism 20 includes a heated ink jet print head 34 and an adjacent transfer drum 36. The print head 34 includes an ink collection reservoir 38 and is pivotable between a first printing position (shown in solid lines,) and a standby position 34' (shown in dashed lines.) The print head 34 has a face plate 40 that is vertical and closely adjacent the transfer drum 36 when the print head 34 is in the printing position. The face plate 40 defines a plurality of orifices (not shown), and the transfer drum has a cylindrical outer support surface 44 onto which ink droplets may be ejected through the orifices to generate an image on the surface 44. When the print head 34 is in the standby position for automatic cleaning and maintenance, the face plate 40 faces somewhat upwardly, making it susceptible to debris, if unprotected.

A drum maintenance cartridge 46 is positioned below the drum 36 to clean the drum surface 44, and to apply the liquid intermediate transfer layer or film of liquid silicone oil with an elevatable felt wick (not shown) to facilitate the subsequent contact transfer of the image to a media sheet. An ink supply unit 50 is positioned above the print head reservoir 38 with a heated melt plate 52 for each primary color (cyan, yellow, magenta, and black color) to dispense melted liquid ink into the reservoir 38 as needed. The ink supply unit 50 contains solid ink blocks of various colors, and controllably melts and dispenses the ink into separate chambers for each color ink of the reservoir 38 via a space between each melt plate 52 (only one of which is shown) and the floor of ink supply unit 50.

The media transport mechanism 18 via paper pick roller 18*a* and transport rollers 18*b*, and 18*c* carries a media sheet (not shown) through a media pathway 56 that extends from the media supply tray 14, through a media preheater 58, over the liquid intermediate transfer layer (not shown) on the transfer drum support surface 44, and out of the printer housing 12 to a media output tray 60. The media pathway 56 exits the preheater 58 and encounters a nip 62 formed along a line of contact between a transfer roller 66 and the transfer drum 36. With the transfer roller 66 in contact with and biased against the drum 36, the image on the drum 36 is transferred to a media sheet passing through the nip.

A media discharge mechanism 70 positioned above the drum 36 receives media from the nip, separates the media from the drum, and transports it out of the printer housing 12 to the output tray 60. The discharge mechanism 70 includes a stripper apparatus 72 having five stripper fingers 74 (see also FIG. 3) with sharp lower leading edges. The stripper apparatus 72 is movable into contact with the drum surface 44 to strip a media sheet from the liquid intermediate transfer layer and the drum support surface 44 and thereby to direct it along the media pathway 56. A pair of upper and lower exit guides 78 and 80 define the media path and guide the media sheet toward a pair of exit rollers 82 and 83 that eject the sheet. The lower exit guide 80 is perforated to permit the free flow of air, with the preferred embodiment being a parallel array of narrow ribs connected with wide spaces between.

At the exit rollers 82, the housing defines a media sheet exit aperture, indicated generally by the numeral 86 through which media sheets exit the housing. The aperture 86 also serves as an air inlet for ventilating the housing 12. The fan 22 is operable to exhaust air from the housing 12 through an air outlet 88. By drawing air through fan housing apertures 90, the fan 22 creates a partial vacuum within the housing 12 that draws in air through any apertures in the housing 12, primarily the media exit aperture 86. Consequently, an air flow path 94 is generated through the housing 12 between the aperture 86 and outlet 88. Air is drawn through the media outlet aperture 86, downwardly along the media path way 56 in the region of the discharge mechanism 70, and through the lower exit guide 80. After passing through the lower exit guide 80, the air flow path 94 proceeds laterally in the space above the transfer drum 36, and through perforations 96 defined in frame member 28. The air flow path then passes above the print head 34, and passes through the gap defined between the ink supply unit 50 and the reservoir 38, after which the air flow is drawn into the fan 22 to be exhausted from the housing 12.

The action of paper transport mechanisms, particularly the upper and lower stripper fingers 73 and 74 and other components that define the media pathway 56, may dislodge a small quantity of dust, paper fiber and other debris from the printer media sheet. The air flow in the housing 12 tends to entrain some of this debris and move it through the housing 12. Some of the entrained debris is disentrained and deposited on printer surfaces by gravity. Most troublesome is debris falling between the nip 62 and stripper assembly 72 onto the support surface 44 of transfer drum 36. Other particles may settle in regions where there is turbulence or stagnation of flow. Horizontal and angled surfaces are particularly vulnerable. Also, surfaces adjacent the air flow path and facing in an upwind direction are impacted with particles in the manner of bugs on a windshield. A relatively smooth air flow pathway without major barriers and cavities will have reduced turbulence and setting of particles. Without shield 32, a vulnerable gap is formed between the print head face plate 40 and the drum support surface 44. The inclusion of the shields 30 and 32 discussed herein minimizes the flow past the face plate 40 and minimizes the portion of the area of the drum support surface 44 that is exposed to air flow.

Figure 3:
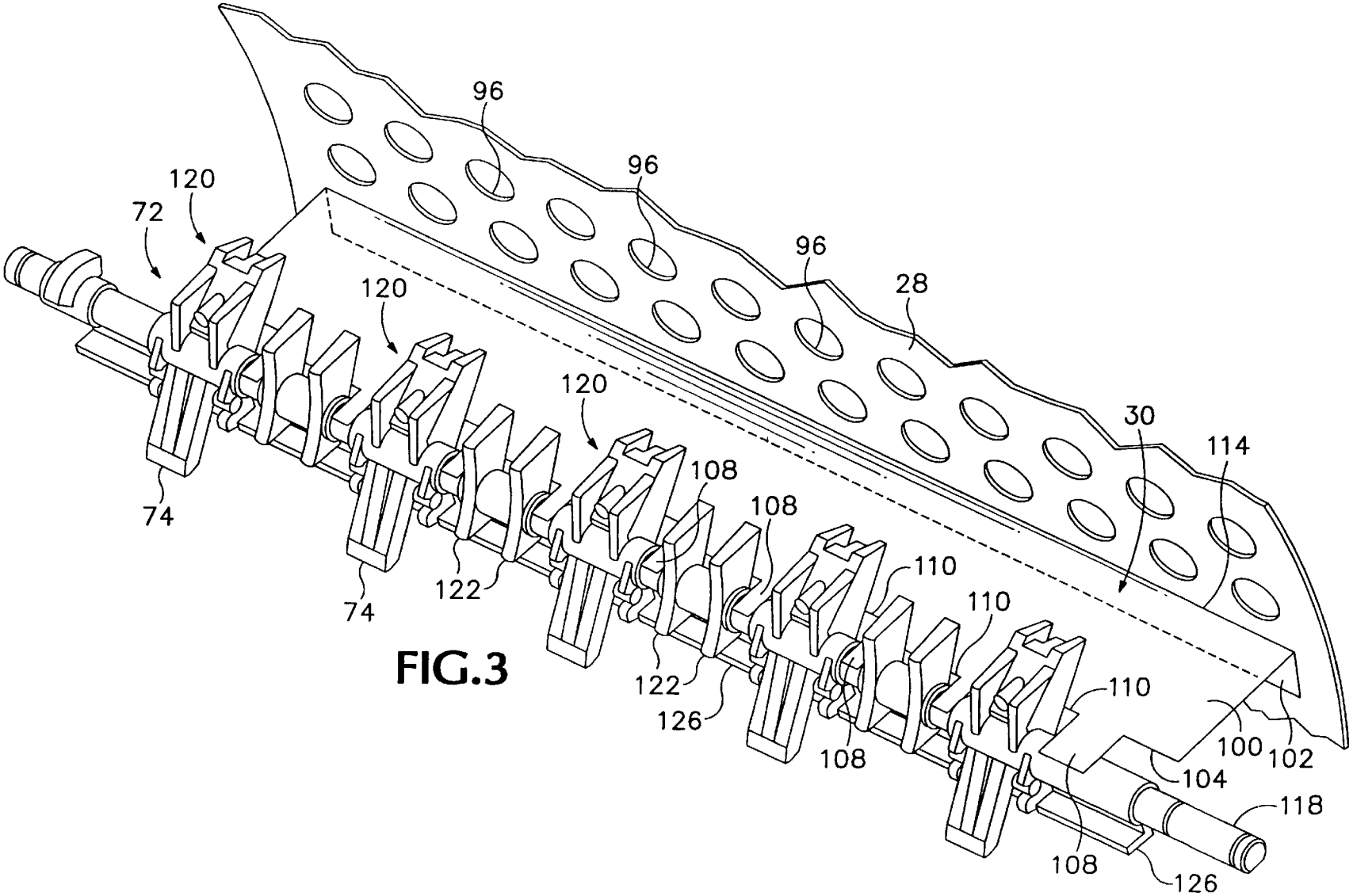
FIG. 3 is an enlarged isometric view of a stripper assembly and debris shield from the printer of FIG. 1.

To minimize the deposition of particles on the transfer drum support surface 44, the first debris shield 30 provides a lower boundary to the air flow path. The first shield 30 is a resilient, flexible, transparent plastic sheet, preferably of a heat resistant plastic such as Kapton® or Mylar®. As shown in FIG. 3, the first shield 30 has an L-shaped cross section, with an elongated horizontal major portion 100 and a downwardly depending flange portion 102. The first shield 30 extends substantially the length of both the stripper assembly 72 and the frame member 28. The flange 102 is adhered to the frame member 28 at a level below the perforations 96. Opposite the flange 102 is a free edge 104, which includes an alternating series of tabs 108 and cutouts 110. The tabs 108 rest upon the stripper assembly 72, with the cutouts 110 conforming to the shape of stripper assembly components to minimize air gaps through which contaminants may fall.

Although the first shield 30 is preferably a sheet of flexible material, such as the preferred 0.010 inch thick Kapton® plastic, it may be formed as a rigid transparent plate that is hinged to the frame member 28. In this case, the junction between portion 100 and flange 102 would form a hinge line 114. A hinged or flexible shield permits certain paper jams to be corrected by the user. If the stripper function should ever be inadequate to remove a media sheet from the drum support surface 44, the sheet would pass beneath the stripper assembly 72 and jam within the region below the first debris shield 30. The flexibility or hinge capability of the shield permits such jams to be easily accessed and the transparency of the plastic material permits such jams to be easily seen. Also, the shield readily yields upwardly in the event that a larger mass of jammed media accumulates below it, reducing excess stresses that may cause damage or complicate the correction of a jam.

The stripper assembly 72 is shown in further detail in FIG. 3. It is formed about a rigid rod 118 that is mounted to a movable mount (not shown) on the printer frame 26. A plurality of spaced-apart stripper elements 120 are mounted on the rod 118, with each element including a single independently pivotable and downwardly biased stripper finger 74. In the gap between each pair of stripper elements, a pair of spaced-apart guide ribs 122 is mounted to upwardly guide printer media sheets. Similar ribs are provided on each stripper element 120, so that a media sheet is smoothly guided toward the lower exit guide 80 and out of the printer 110. The space between stripper elements 120 and guide ribs 122 permits air flow over the first debris shield 30. The tabs 108 of the debris shield 30 rest between the stripper elements 120 and ribs 122, and may rest directly upon exposed portions of the rod 118.

To reduce air flow below the rod 118, the stripper assembly 72 includes a set of webs 126 spanning between and extending beyond the stripper elements 120. The webs 126 form an air flow barrier extending the length of the stripper assembly 72. This barrier provides only a small, limited gap 128 (shown in FIG. 2) between the lower edges of the webs 126 and the drum support surface 44.

Returning to FIG. 2, the second debris shield 32 is a rigid metal plate attached to the frame element 28 at a location below the perforations 96 and positioned vertically above the print head 34. The second shield 32 extends the length of the drum 36 and print head 34, and is connected to the frame member 28 by a pair of hooks that grasp the lower edges of two of the perforations 96. The ends of shield 32 are also secured to the frame 26. The shield 32 is cantilevered away from the frame member 28, with a horizontal portion 130 extending laterally to the right away from the frame member 28 at a level similar to the level of the first shield 30. An angled portion 132 of the shield 32 extends at a downward angle away from the horizontal portion 130, and terminates at a free edge 136. The free edge 136 is positioned at a level above the upper surface of the print head reservoir 38 and below the lower surface of the ink supply unit 50. The free edge 136 is positioned laterally to the left (upwind) of the ink supply outlet 52, which is to the left of the right edge of the reservoir 38. Thus, ink may freely drop from the outlet 52 into the reservoir 38, and air may flow through the gap defined above the free edge 136 of the shield 32 and below the lower left edge of the ink supply 50. To protect the face plate 40' when the print head 34 is in the standby position 34', the upper edge of the face plate 40 must remain to the left of the free edge 136.

In the preferred embodiment, the print head orifices are typically about 50–90 microns in diameter. During printing, the gap between the face plate 40 and the drum support surface 44 is between about 0.25 and 1.0 mm. Typical paper fibers, with diameters of 10 microns and up, have lengths in the range of 0.1 and 5.0 mm. Because such fibers may exceed the head-to-drum gap width, any fibers lodging in the oil liquid intermediate transfer surface or film on the drum surface 44 may be readily transferred to the face plate 40. Fibers having diameters less than the orifices may cause insertive obstructions, and any fiber may rest flat on the face plate to partially or entirely overlay an orifice.

In conjunction with the beneficial effect of the debris shields 30 and 32 discussed above, the printer operates in a sequence to minimize these drum-to-head fiber transfers. As discussed above, these fibers typically fall onto the drum support surface 44 from above between the nip 62 and the stripper assembly 72. Before an image is jetted onto the liquid intermediate transfer surface on the drum, the drum is wiped of particles and the liquid oil layer film is replenished while the print head 34 is positioned away from the drum 36 by a gap greater than the length of most fibers. The image is then applied, after which the print head 34 is moved away from the drum 36. With the print head 34 clear, a media sheet is advanced to the nip 62 for image transfer. The sheet is then stripped from the drum support surface 44 by the stripper fingers 73 and 74 and ejected. Because advancing, stripping, and ejecting the media sheet are primary sources of debris, it is important for the print head 34 to have been moved away from the drum 36 to avoid collecting any newly deposited fibers from the drum 36. For printing additional sheets, the cycle is repeated, beginning with wiping of the drum support surface 44 by the aforementioned selectively elevatable felt wick which is impregnated with silicone oil in the drum maintenance cartridge 46.

During brief periods between printing activity, it is necessary to maintain temperature uniformity of the drum support surface 44. The drum support surface 44 is maintained at about 55° C., while the print head face plate 40 is maintained at about 140° C. Thus, there is normally a heat transfer from the face plate 40 to the adjacent portion of the drum support surface 44. To avoid over heating of the adjacent portion, the drum 36 is rotated every 15 seconds in the clockwise direction by 31 degrees, exposing a new surface area to the heat emanating from the face plate 40. The thermal effect that occurs in 15 seconds is small enough to keep the drum support surface 44 temperature uniformity within tolerances. This has the effect of a rotisserie, and maintains the drum support surface 44 at a generally uniform temperature. While the print head 34 may be moved to the standby position to avoid non-uniform drum heating, this is done only for long standby periods in excess of 2 minutes; restarting from such a full standby mode requires a delay for reheating of the printer surfaces.

When a media sheet is printed, a small "dead zone" portion of the drum support surface 44 does not carry any portion of the image, and is not contacted by the sheet. This is because the drum 36 radius must be at least slightly greater than the length of the longest media sheet to be printed. The transfer process has a cleaning effect by which debris may be harmlessly transferred from the drum support surface 44 and the liquid intermediate transfer surface to a media sheet. However, the dead zone of the drum support surface 44 and its liquid intermediate transfer surface does not benefit from the transfer of debris to the sheet. Therefore, in one embodiment it is important to avoid rotating the drum 36 so that the dead zone passes close to the print head 34.

When a printed media sheet has been ejected, the dead zone on the clockwise-rotating drum support surface 44 has rotated just past the nip, and faces generally upward. The rotisserie cycle discussed above would bring the dead zone adjacent to the print head 34 within 15 or 30 seconds. To avoid this, and to avoid having to put the print head 34 in the full standby position for such a short delay, the drum 36 is rotated counterclockwise about 217 degrees after the media sheet is ejected. This permits the drum 36 to be rotated through at least eight rotisserie increments before the dead zone encounters the print head 34. Before such an encounter occurs, the print head 34 is moved to the full standby position at 2 minutes after printing. Before the print head is returned to the printing position, the drum support surface 44 is cleaned as discussed above. Alternatively, the print head 44 could be moved away from the drum support surface 44 immediately upon completion of the imaging process by the utilization of an additional print head 34 movement drive mechanism that would obviate the need for concern about particles of debris falling from the dead zone of the drum support surface 44 into the orifices of the print head face plate 40.

While a preferred embodiment has been described, the invention is not intended to be so limited. For example, while this invention is described in the context of a phase change ink type of printer, it is possible that the invention could be employed in any type of a printer, with either permanent or replaceable ink jet print heads as long as there are small orifices susceptible to clogging or obstruction by printing debris.

What is claimed is:

1. An ink jet printer for generating images on media sheets, the printer comprising:

a printer housing including an outlet aperture and at least a first inlet aperture;

a frame contained within the housing and connected thereto;

a printing mechanism connected to the frame, the printing mechanism comprising an ink jet print head having a plurality of ink ejecting orifices disposed on a face plate, the print head operable to expel droplets of ink through the orifices and onto an adjacent receiving surface;

a ventilator connected to the frame and contained within the housing and operable to exhaust air through the outlet aperture;

a media transport mechanism connected to the frame and contained within the housing, the transport mechanism including a media pathway having at least a portion passing adjacent to at least a portion of the printing mechanism, such that media passing through the media pathway may be imprinted by the printing mechanism;

the housing including an air flow pathway passing between the inlet aperture and the outlet aperture, and the ventilator being disposed in the air flow pathway, such that air flows along the air flow pathway in response to operation of the ventilator, at least a first portion of the air flow pathway passing through a position vertically above at least a first portion of the printing mechanism; and a debris shield connected to the frame and including a lower boundary of at least a portion of the first portion of the air flow pathway, the debris shield being located vertically above the printing mechanism and the plurality of ink ejecting orifices to prevent the orifices from becoming obstructed by debris entrained within the air flow pathway and falling downwardly therefrom toward the printing mechanism and the orifices.

2. The printer of claim 1 wherein the debris shield comprises a first portion and a second portion separately movable with respect to each other.

3. The printer of claim 1 wherein the debris shield is transparent, such that media jams beneath the shield are visible to facilitate diagnosis.

4. The printer of claim 1 wherein the printing mechanism includes a moving surface defining a portion of the media pathway and a plurality of stripper fingers movable into contact with the moving surface, such that media adhered to the moving surface may be separated therefrom by the stripper fingers, the stripper fingers including at least a first gap therebetween, at least a first portion of the first gap being blocked by a portion of the debris shield.

5. The printer of claim 4 wherein the stripper fingers are positioned vertically above at least a portion of the moving surface.

6. The printer of claim 1 wherein the debris shield is at least partially movable, such that the space below the debris shield may be accessed to facilitate correction of media jams.

7. The printer of claim 6 wherein the debris shield is a resilient flexible sheet.

8. The printer of claim 6 wherein the debris shield includes a hinge joint.

9. The printer of claim 1 wherein the adjacent receiving surface comprises a transfer surface on which an image is generated prior to transfer to a media sheet.

10. The printer of claim 9, wherein the debris shield includes a first portion positioned vertically above the transfer surface, and a second portion positioned vertically above the plurality of ink ejecting orifices on the print head.

11. The printer of claim 9 wherein the debris shield is positioned above at least a portion of the transfer surface.

12. The printer of claim 11 wherein the print head is movable between a printing position and a standby position, and wherein the debris shield extends laterally at least between a position vertically above the face plate when the print head is in the printing position and a position vertically above the face plate when the print head is in the standby position.

13. An ink jet printer for generating images on media sheets, the printer comprising:

a printer housing;

a frame contained within the housing and connected thereto;

a printing mechanism connected to the frame and contained within the housing, the printing mechanism comprising an ink jet print head having a plurality of ink ejecting orifices disposed on a face plate, the print head operable to expel droplets of a phase change ink through the orifices and onto an adjacent transfer surface, such that an image is formed on the transfer surface for transfer to a media sheet;

a media transport mechanism connected to the frame and contained within the housing, the transport mechanism including a media pathway having at least a portion passing adjacent to the transfer surface, such that media passing through the media pathway may receive the image from the transfer surface; and a debris shield connected to the frame and adjacent to and vertically above at least a portion of the plurality of ink ejecting orifices, such that debris moving within the housing toward the ink ejecting orifices is collected on or deflected by the debris shield to protect the ink ejecting orifices from becoming obstructed by the debris.

14. The printer of claim 13 wherein the debris shield includes a first portion positioned vertically above the transfer surface, and a second portion positioned vertically above the plurality of ink ejecting orifices on the print head.

15. The printer of claim 13 wherein the debris shield is transparent.

16. The printer of claim 13 wherein the media transport mechanism includes a plurality of stripper fingers positioned adjacent the transfer surface, the fingers including gaps therebetween, each of the gaps being blocked at least partially to prevent debris transmission therethrough by at least a portion of the debris shield.

17. The printer of claim 16 wherein the print head is movable between a printing position and a standby position, and wherein the debris shield extends laterally between a position vertically above the face plate when the print head is in the printing position and a position vertically above the face plate when the print head is in the standby position.

* * * * *